United States Patent [19]

Seto et al.

[11] Patent Number: 5,031,435

[45] Date of Patent: Jul. 16, 1991

[54] ADJUSTABLE WIDTH ROLLS FOR ROLLING MILL

[75] Inventors: Tsuneo Seto; Atsushi Hatanaka; Hironori Miura; Yoji Fujimoto, all of Kurashiki; Hiroyuki Hayashi, Chiba, all of Japan

[73] Assignee: Kawasaki Steel Corporation, Kobe, Japan

[21] Appl. No.: 363,088

[22] Filed: Jun. 8, 1989

[30] Foreign Application Priority Data

Jun. 16, 1988 [JP] Japan ..... 63-146947
Apr. 27, 1989 [JP] Japan ..... 1-105816
Jun. 6, 1989 [JP] Japan ..... 1-142169

[51] Int. Cl.[5] ..... B21B 31/18

[52] U.S. Cl. ..... 72/247; 72/238; 72/225; 29/125

[58] Field of Search ..... 72/247, 238, 225, 181, 72/182, 180, 249, 199, 224; 29/125, 124

[56] References Cited

U.S. PATENT DOCUMENTS 1,078,240 11/1913 Barbour ..... 72/247
4,546,632 10/1985 Kieboom ..... 29/125

FOREIGN PATENT DOCUMENTS 43991 12/1979 Japan ..... 72/247
10366 1/1980 Japan ..... 72/247
68106 5/1980 Japan ..... 72/241.4
209722 12/1982 Japan ..... 72/247
60-72603(A) 9/1983 Japan .
61-17310(A) 7/1984 Japan .
59-202101 11/1984 Japan .
61-262407(A) 5/1985 Japan .
17310 1/1986 Japan ..... 72/247
61-169105 7/1986 Japan .
61-172605 8/1986 Japan .
61-262407 11/1986 Japan ..... 72/247
156007 7/1987 Japan ..... 72/247
63-56302 3/1988 Japan .

*Primary Examiner*—Daniel C. Crane
*Attorney, Agent, or Firm*—Oliff & Berridge

[57] ABSTRACT

Adjustable width rolls are preferably used for rolling, for example, insides of H-beams of various sizes without exchanging horizontal rolls of a rolling mill. Each of the adjustable width rolls includes a roll shaft rotatably and axially movably supported relative to the rolling mill, and axially adjustable sleeve roll fixed to the roll shaft, and an axially stationary sleeve roll mounted on the roll shaft to be axially slidable but against rotatable relatively to the roll shaft. The adjustable width roll further includes an axially adjustable roll fixedly supported by the axially adjustable sleeve roll to form substantially one half of a rolling barrel of the adjustable width roll, an axially stationary roll fixedly supported by the axially stationary sleeve roll to form substantially the remaining half of the rolling barrel of the adjustable width roll, and a driving mechanism for driving the roll shaft in axial directions of the roll shaft.

14 Claims, 11 Drawing Sheets

15
14
13
12
10
11
20
16
17
8
21
RR
22
LR
5a
9
8
7
6
IV
IV
III
III
19
18
H'
H
5b
4a
1
2b
3b
2a
3a
4b

ADJUSTABLE WIDTH ROLLS FOR ROLLING MILL

BACKGROUND OF THE INVENTION

This invention relates to adjustable width rolls for a rolling mill, and more particularly to adjustable width rolls particularly suitable for horizontal rolls of a universal mill used for producing H-beams or the like.

In order to produce H-beams by rolling, universal mills are generally used, in which a pair of horizontal rolls arranged above and below and a pair of vertical rolls arranged on both sides are incorporated in the same roll stand.

In the case that H-beams are produced by the use of such a rolling mill, widths of flanges of H-beams can be freely changed so long as the widths of the flanges are within widths of vertical rolls. On the other hand, as web heights h of the H-beams are determined by thicknesses $t_1$ of the flanges and widths W of the horizontal rolls reSulting from a relation $h=W+2t_1$, there are the following difficulties concerning the web heights.

The expression "width of roll or roll width" used herein is intended to mean a barrel length of a roll which directly contacts a product to be rolled.

1) End surfaces of the horizontal rolls perform reduction and rolling of inner surfaces of H-beams so that wear occurs at the end surfaces to a great extent. Therefore, the heights of the H-beams tend to reduce even in one rolling procedure as rolled amounts are increased, so that rolled products having a constant size cannot be stably obtained. It is therefore required to frequently exchange the rolls in order to produce rolled products of a constant size.
2) Although the widths of the flanges of H-beams can be freely selected, the heights of webs are limited to only one size per one pair of horizontal rolls.
3) With H-beams having a constant height h, there are many flange thiCkneSses $t_1$ in the relation $h=W+2t_1$ under one nominal size. Therefore, it is needed to change the widths W of the horizontal rolls dependent upon required thicknesses $t_1$ so that the horizontal rolls must frequently be exchanged to meet the requirements of thicknesses. As a result, the productivity is detrimentally affected and the number of man-hours are increased.
4) The end surfaces of the horizontal rolls must be frequently machined to make the roll widths W of the horizontal rolls coincident with inner sizes $W_1$ in order to improve the accuracy in size. Therefore, the cost per one roll is increased (FIG. 5).

In order to solve the above problems, there have been many proposals. For example, Japanese Patent Applications Laid-open Nos. 61-262,407 and 61-169,105 proposed features of inserting spacers for adjusting roll widths between a pair of sleeve rolls to compensate for the wear of rolls (FIG. 1). Moreover, Japanese Patent Application Laid-open No. 61-262,407 disclosed a feature of moving sleeve rolls in their axial directions relative to their centers with the aid of screws and nuts threadedly engaging with each other to adjust widths of the rolls. Furthermore, Japanese Patent Applications Laid-open Nos. 59-202,101; 61-172,605; and 63-56,302 proposed features of using rolls obliquely moving to freely change heights of webs of H-beams.

In the system using the spacers inserted between the sleeve rolls, the horizontal rolls must be removed from a roll stand in an off-line for the purpose of inserting the spacers into or removing from the sleeve rolls. These operations detrimentally affect the production efficiency, and the number of man-hours for mounting and dismounting is increased. What is worse still, fine adjustment of roll widths is difficult in this system.

In the system moving the sleeve rolls in their axial directions, complicated means for driving the sleeve rolls is required and the rigidity of the sleeve rolls in transverse directions becomes lower. Moreover, when rolling load is applied, horizontal rolls wobble in their axial directions, so that rolled products are inferior in dimensional accuracy.

In the system using the rolls obliquely movable, installations for this purpose are greatly complicated to prohibitively increase the initial cost.

SUMMARY OF THE INVENTION

It is a primary object of the invention to provide adjustable width rolls for a rolling mill, which eliminate the disadvantages of the prior art and which are able to change widths of the rolls with ease without exchanging rolls of different widths and particularly suitable for horizontal rolls of a universal mill in producing shape steels of constant or various sizes.

It is another object of the invention to provide adjustable width rolls for a rolling mill, which are able to change widths of the rolls in a simple manner and easily assembled and disassembled.

In order to achieve these objects, each of adjustable width rolls for a rolling mill according to the invention comprises a roll shaft rotatably and axially movably supported relative to the rolling mill to form an axle member of the adjustable width roll, an axially adjustable sleeve roll fixed to the roll shaft, an axially stationary sleeve roll mounted on the roll shaft to be axially slidable but against rotatable relatively to the roll shaft, an axially adjustable roll fixedly supported by the axially adjustable sleeve roll to form substantially one half of a rolling barrel of the adjustable width roll, an axially stationary roll fixedly supported by the axially stationary sleeve roll to form substantially the remaining half of the rolling barrel of the adjustable width roll, and driving means for driving said roll shaft in at least one axial direction thereof.

In an embodiment of the invention, the driving means comprises a motor for axially driving said roll shaft, a nut arranged to be rotatively driven by the motor, a slide block threadedly engaged with the nut and axially moved when the nut is rotated by the motor, and an arbor engaging said slide block and said roll shaft so that the roll shaft is moved in one axial direction when the slide block is axially moved.

In another embodiment of the invention, the adjustable width roll further comprises a support casing supporting the driving means and surrounding one end of the roll shaft on a side of the driving means. The support casing is threadedly engaged with a roll chock of the adjustable width roll and provided on its outer circumference with a gear. There is provided a mounting and dismounting apparatus comprising a gear to be in mesh with the gear provided on the support casing and driven by a driving power source, rollers for supporting the support casing, and position adjusting means for adjusting positional relations between the support casing and the gear and the rollers provided on the mounting and dismounting apparatus.

The invention will be more fully understood by referring to the following detailed specification and claims taken in connection with the appended drawings.

DETAILED EXPLANATION OF THE PREFERRED EMBODIMENTS

Figure 1:
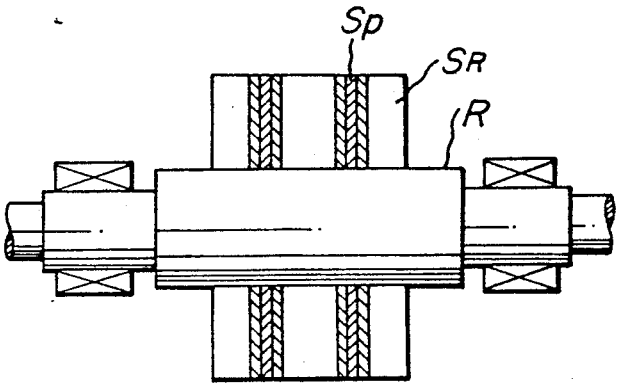
FIG 1 PRIOR ART
FIG. 1 is a partial sectional view illustrating a roll for a rolling mill of the prior art.
Figure 3:
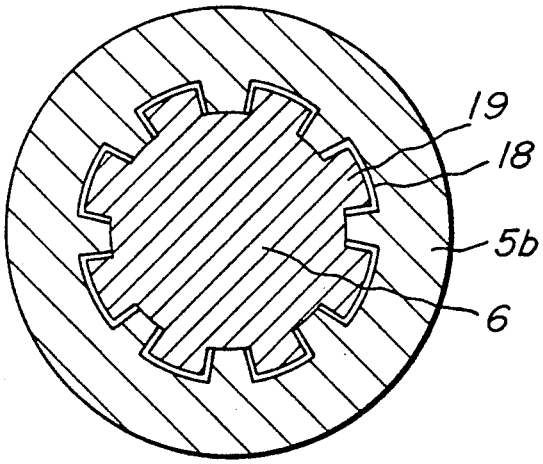
FIG. 3 is a sectional view taken along the line III—III in FIG. 2.
Figure 2:
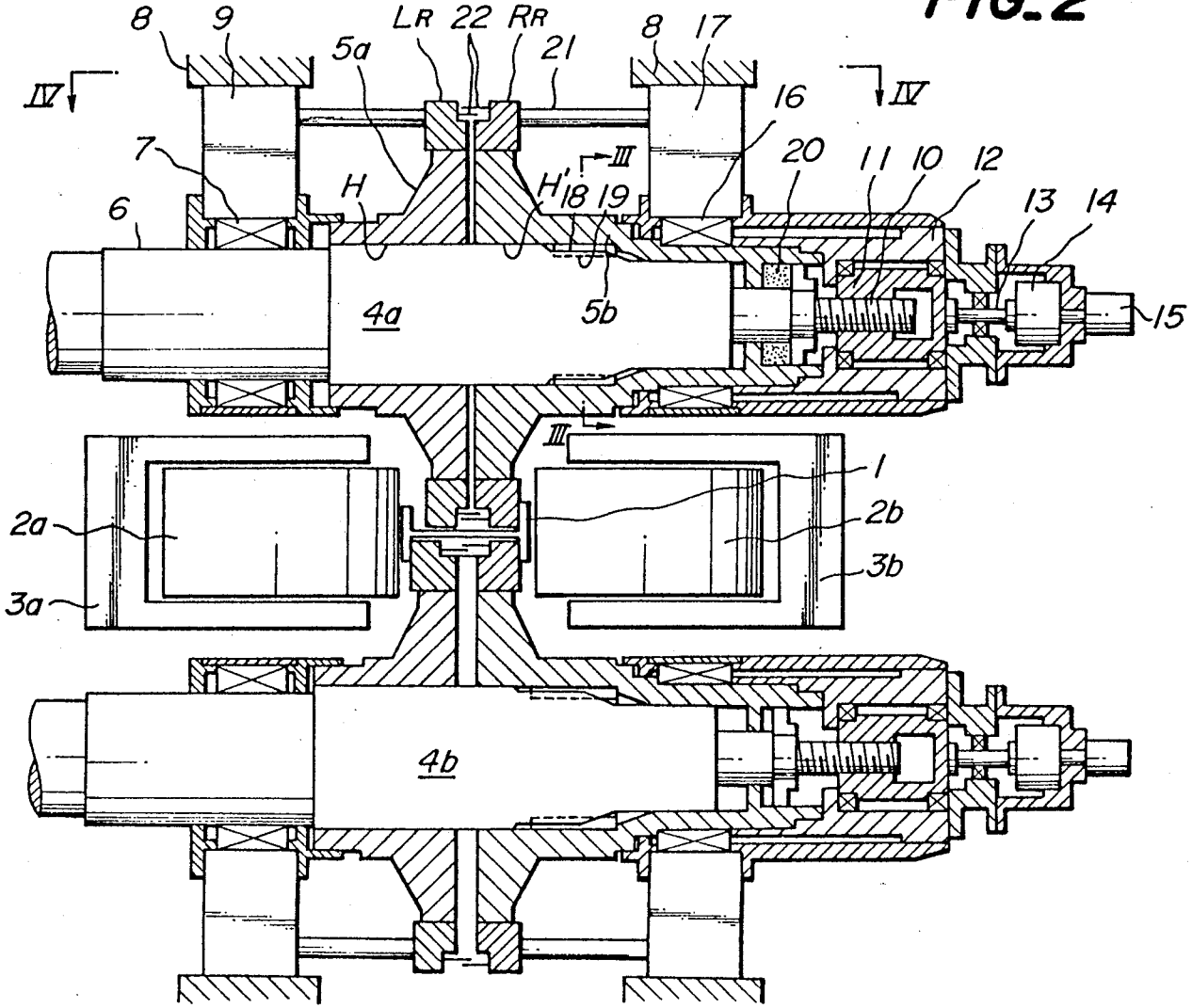
FIG. 2 is a sectional view illustrating adjustable width rolls according to the invention.
Figure 4:
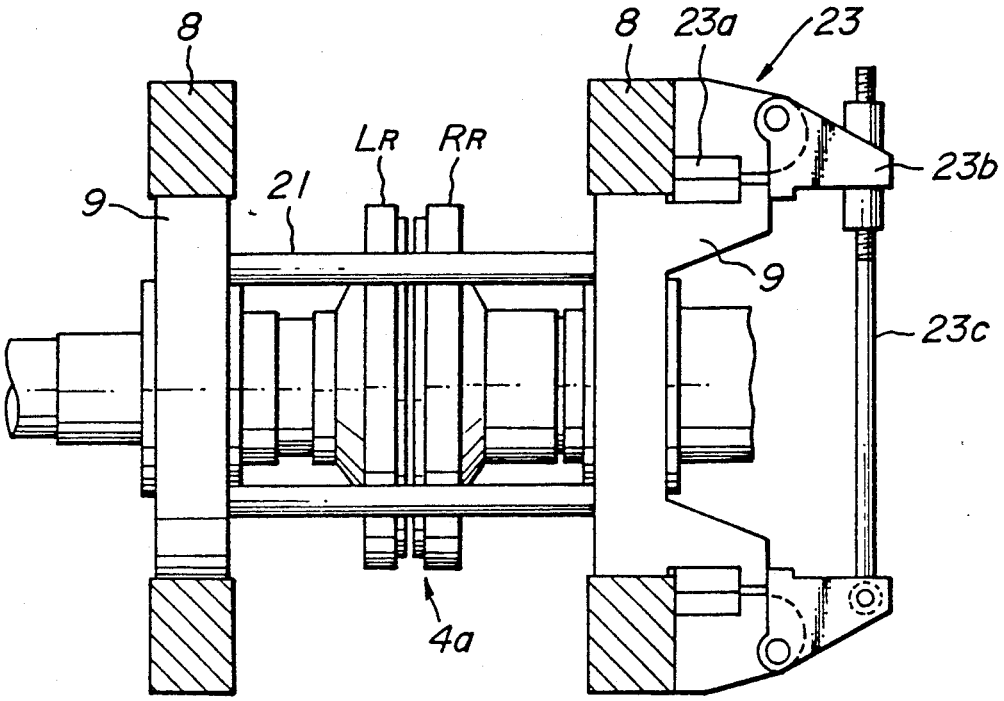
FIG. 4 is a sectional view taken along the line IV—IV in FIG. 2.

FIGS. 2–4 illustrate one embodiment of the adjustable width rolls according to the invention assembled as horizontal rolls in a universal rolling mill. The universal rolling mill includes vertical rolls 2*a* and 2*b* for rolling outer surfaces of flanges of an H-beam 1, bearing chocks 3*a* and 3*b* for rotatably supporting the vertical rolls 2*a* and 2*b*, and a pair of horizontal rolls 4*a* and 4*b* arranged above and below having roll width changing means which will be explained hereinafter.

The horizontal rolls 4*a* including the roll width changing means according to the invention will be explained in detail hereinafter because the horizontal rolls 4*a* and 4*b* are substantially the same construction. The left side in FIG. 2 is a driving side contiguous to driving means of the rolling mill and the right side is an operating side of the rolling mill having its controlling means.

A sleeve roll of the horizontal roll 4*a* is formed in a two-divided construction as shown at 5*a* and 5*b* and includes an axially adjustable roll $L_R$ on the driving side and an axially stationary roll $R_R$ on the operating side of the rolling mill. These rolls $L_R$ and $R_R$ serve to roll the web and inner surfaces of flanges of the H-beam 1. An axially adjustable sleeve roll 5*a* for supporting the axially adjustable roll $L_R$ fixed thereto is fitted on a roll shaft 6 as an axle member of the horizontal roll 4*a* by means of thermal-shrinkage with a through-hole H of the sleeve roll 5*a*. One end of the roll shaft 6 is supported through a bearing 7 by a bearing chock 9 fitted in a roll stand housing 8.

The roll shaft 6 is connected to driving means (not shown) for transmission of torque required to drive the horizontal roll 4*a*.

At the other end of the roll shaft 6 on the operating side there is provided a screw rod 10 coaxially fixed to the end of the roll shaft 6 as moving means for sliding the roll shaft 6 in its axial directions and having a nut 11 adapted to be threadedly engageable on the screw rod 10.

The nut 11 is rotatably supported by a nut receiving box 12 and connected through a connecting shaft 13 and a speed reduction device 14 to a hydraulic motor 15 for rotating the nut 11. It is of course that when the motor 15 is rotated in a normal or reverse direction, the roll shaft 6 is slid in a normal or reverse direction.

On the other hand, an axially stationary sleeve roll 5*b* supporting an axially stationary roll $R_R$ fixed thereto is supported as a cantilever by a bearing 16 in a bearing chock 17 fitted in a roll stand housing 8. The roll shaft 6 is fitted in a through hole H' of the sleeve roll 5*b*. An inner surface of the through-hole H' is formed with, for example, spline grooves 18, and an outer circumferential surface of the roll shaft 6 is formed with spline teeth 19 correspondingly to the spline grooves 18 as shown in FIG. 3. Therefore, when the driving means (not shown) of the rolling mill connected to the roll shaft 6 is actuated, the sleeve roll 5*a* on the operating side is rotated together with the roll shaft 6.

A hydraulic chamber 20 is formed between the sleeve roll 5*b* and the roll shaft 6 and connected to a hydraulic pressure supply and exhaust circuits for preventing axial wobbling and elastic deformation of the associated members such as the roll shaft 6 and sleeve roll 5*b*. The bearing chocks 9 and 17 on the driving and operating sides are connected by tie bars 21. Scale covers 22 are provided between the driving and operating rolls $L_R$ and $R_R$ to prevent foreign particles from entering between the sleeve rolls. Referring to FIG. 4, position adjusting means 23 comprising stoppers 23*a*, levers 23*b* and an adjusting screw rod 23*c* is provided for adjusting central positions of the horizontal roll 4*a*.

The operation for adjusting widths of the horizontal roll 4*a* with the above arrangement will be explained hereinafter.

FIG. 2 illustrates the upper horizontal roll 4*a* with the contracted width and the lower horizontal roll 4*b* with the expanded width. In order to expand the upper horizontal roll 4*a* to the equal extent to that of the lower horizontal roll 4*b*, first the motor 15 is actuated to rotate the nut 11 through the speed reduction device 14 and the connecting shaft 13. The rotation of the nut 11 causes the screw rod 10 to move away from the motor 15 so that the roll shaft 6 is moved toward the left side viewed in FIG. 2 sliding in the through-hole H' and the bearing 7. Therefore, the total roll width of the axially adjustable and stationary rolls $L_R$ and $R_R$ respectively fixed to the sleeve rolls 5*a* and 5*b* is changed to a new value as in the lower horizontal roll 4*b*.

During such an operation, the hydraulic pressure supply and exhaust circuits are kept opened or disconnected so as not supply any hydraulic pressure to the hydraulic chamber 20. Immediately after the new roll width has been set, the hydraulic pressure is supplied to the hydraulic chamber 20 to set the pressure in the chamber 20 at a predetermined value so as not permit the roll shaft 6 to wobble in its axial directions.

In this case, when the hydraulic pressure is supplied to the hydraulic chamber 20 to set the predetermined pressure in the chamber 20, an elastic deformation of the horizontal roll 4a occurs due to a load acting upon the hydraulic chamber 20. In setting the roll width, therefore, it must be set on a larger side by a value corresponding to the deformation of the horizontal roll 4a. In practice, the elastic deformation $\epsilon_X$ is indicated in the following equation.

$$\epsilon_X = W_O / K_X$$

$W_O$: load acting upon hydraulic chamber (ton)
$K_X$: transverse rigidity (ton/mm)
$\epsilon_X$: elastic strain (mm)

Therefore, the load $W_O$ acting upon the hydraulic chamber 20 is set at a value slightly larger than axial loads generated in rolling operation.

Although the driving source for adjusting the roll width is the motor 15 in this embodiment, an electric motor may be used for the purpose. Moreover, if a detector for detecting moved distances of the roll is provided, the roll width is changed with higher accuracy.

As can be seen from the above description, according to the invention the roll width can be easily changed even when on-line without any problems. In the event that the invention is applied to horizontal rolls of a universal rolling mill for producing H-beams, even if wear occurs on the rolls, products having constant dimensions can be produced stably and products of various sizes can be produced with ease without exchanging different rolls.

Figure 6A:
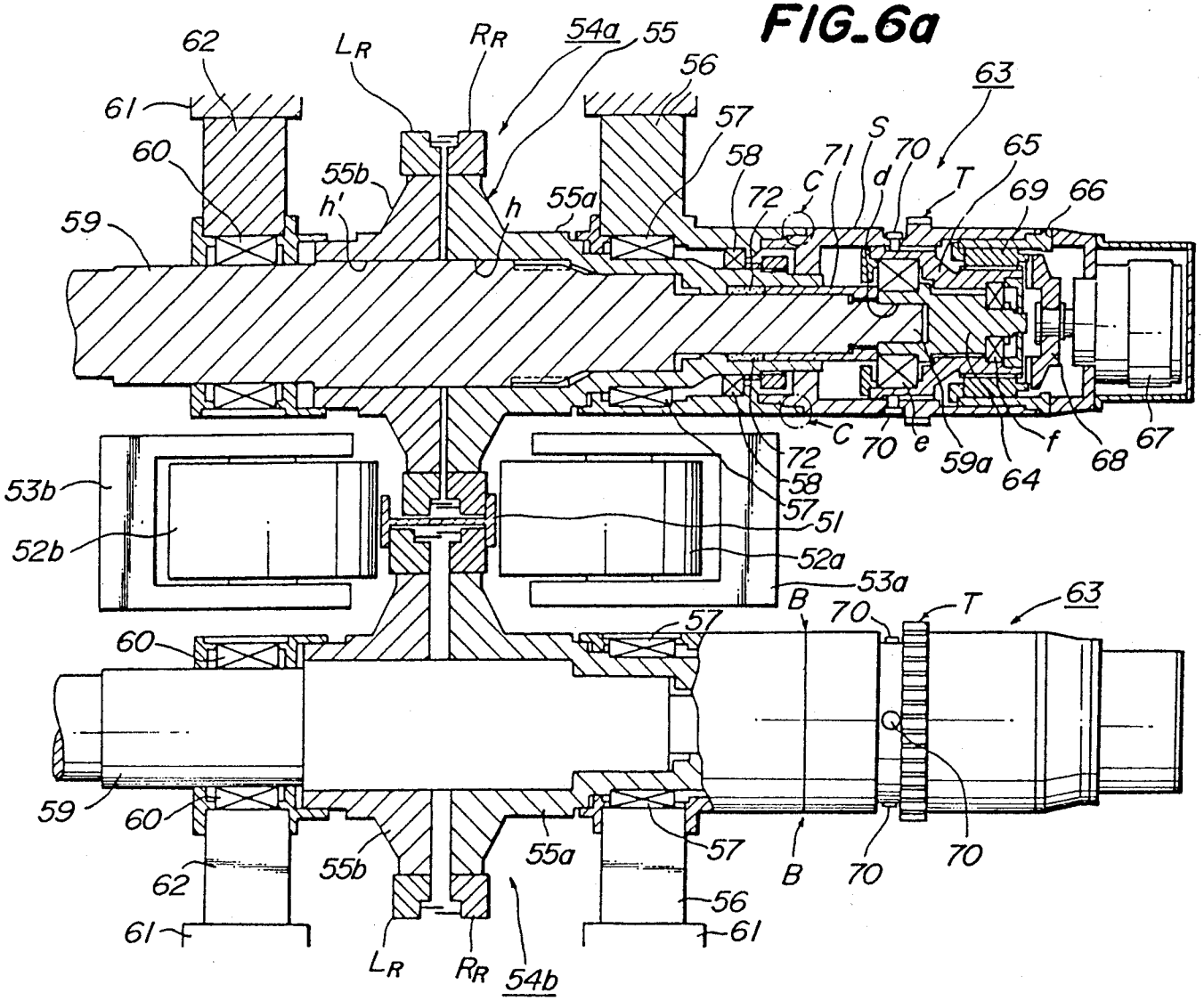
FIG. 6*a* is a sectional view of adjustable width rolls of another embodiment of the invention.
Figure 6B:
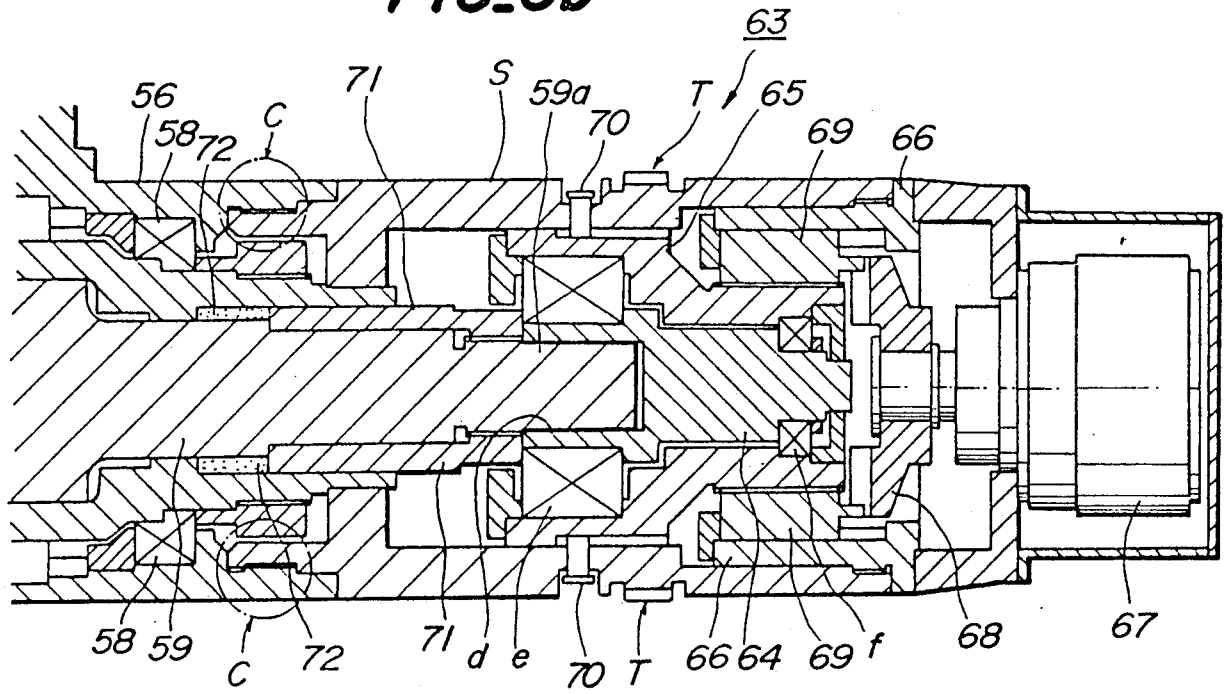
FIG. 6*b* is a partial sectional view illustrating one end of the adjustable width roll shown in FIG. 6*a;*

FIGS. 6a and 6b illustrate second embodiment of the invention which makes mounting and dismounting adjustable width rolls of a rolling easier. The universal rolling mill includes vertical rolls 52a and 52b for rolling outer surfaces of flanges of an H-beam 51, bearing chocks 53a and 53b for rotatably supporting the vertical rolls 52a and 52b, and a pair of horizontal rolls 54a and 54b arranged above and below and each having one end connected to roll driving means (not shown) and the other end connected to roll width changing means according to the invention.

In the following explanation, as in the first embodiment the driving side is the left side viewed in FIG. 6a where the roll driving means (not shown) are arranged, and the operating side is the right side in FIG. 6a where the roll width changing means are located. As the constructions of the upper and lower horizontal rolls 54a and 54b are quite the same, only the upper horizontal roll 54a will be explained.

As in the first embodiment, a sleeve roll of the horizontal roll 54a is formed in a two-divided construction as shown at 55a and 55b and includes an axially adjustable roll $L_R$ on the driving side and an axially stationary roll $R_R$ on the operating side of the rolling mill. These rolls $L_R$ and $R_R$ serve to roll the web and inner surfaces of flanges of the H-beam 51. An axially stationary sleeve roll 55a for supporting the axially stationary roll $R_R$ fixed thereto is formed at its center with a through-hole h and rotatably supported in a cantilever by a bearing 57 (against radial loads) fixed in a bearing chock 56 and a bearing 58 (against thrust loads).

An axially adjustable sleeve roll 55b for fixedly supporting an axially adjustable roll $L_R$ on the driving side is formed with a through-hole h' and fitted on the roll shaft 59 by means of thermal-shrinkage.

The roll shaft 59 has one end on the driving side rotatably supported in a bearing 60 in a chock 62 fitted in a housing 61 and the other part fitted in a through-hole h of an axially stationary sleeve roll 55a for fixedly supporting the axially stationary roll $R_R$ with a spline fitting as shown in FIG. 3.

When the driving means (not shown) of the rolling mill connected to the roll shaft 59 is actuated, the rolls $L_R$ and $R_R$ supported by the sleeve rolls 55b and 55a are rotated together with the roll shaft 59 to perform the rolling of the H-beam 51.

Figure 7:
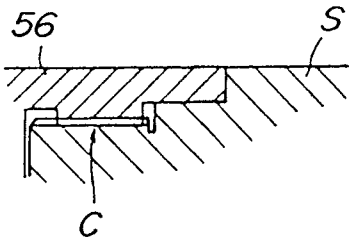
FIG. 7 is a partial sectional view of a part shown in FIG. 6*b;*

The roll width changing means 63 of this embodiment is fixed to the roll chock 56 at a portion circumscribed by a circle c in FIG. 6a (FIG. 7 in enlarged scale) by a threaded engagement. As shown in FIG. 6b partially illustrating one end of the roll shaft 59 in an enlarged scale, a support casing S is provided on its outer circumference with a gear T adapted to engage with a mounting and dismounting apparatus later explained. In the support casing S there are provided an arbor 64 having an opening d for receiving one end 59a of the roll shaft 59, a slider block 65 for rotatably supporting the arbor 64 by a bearing e (against thrust loads of the roll shaft) and a bearing f (against radial loads of the roll shaft), a nut receiving box 66 fixed to the support casing S, a clutch 68 connected to a driving power source 67 such as an electric motor, and a nut 69 rotatably supported in the nut receiving box 66 and adapted to be driven by the clutch 68 in threadedly engaging with the slider block 65.

The arbor 64 and the end 59a of the roll shaft 59 are connected by a simple fitting connection them to move axially relative to each other although it is not shown in the drawing.

When the nut 69 is rotated, the slider block 65 is axially moved sliding on an inner surface of the support casing S together with the roll shaft 59 in an axial direction.

A pin 70 prevents the slider block 65 from rotating relatively to the support casing S. A hydraulic chamber 72 is formed between the roll shaft 59 and the sleeve roll 55a with the aid of the sleeve 71 and connected with hydraulic pressure supply and exhaust circuits for preventing axial wobbling and elastic deformation of the roll shaft 59.

The hydraulic chamber 72 of course serves to prevent axial wobbling and elastic deformation of the associated members as in the first embodiment. However, the hydraulic chamber 72 in the second embodiment has an important function which moves the roll shaft 59 in the direction to shortening or narrowing the total width of the rolls $L_R$ and $R_R$. In other words, after the arbor 64 has been retracted by the reverse rotation of the motor 67, the hydraulic pressure is applied into the hydraulic chamber 72, so that the prevailed pressure in the chamber 72 causes the chamber to expand to move the roll shaft 59 and the sleeve 71 away from each other. However, the sleeve roll 55a is stationary and therefore the sleeve 71 is moved together with the roll shaft 59 threadedly connected thereto onto the operating side or the right viewed in FIG. 6a or 6b. As a result, the hydraulic chamber 72 serves as roll width changing means which makes narrow the total width of the rolls $L_R$ and $R_R$.

Figure 8A:
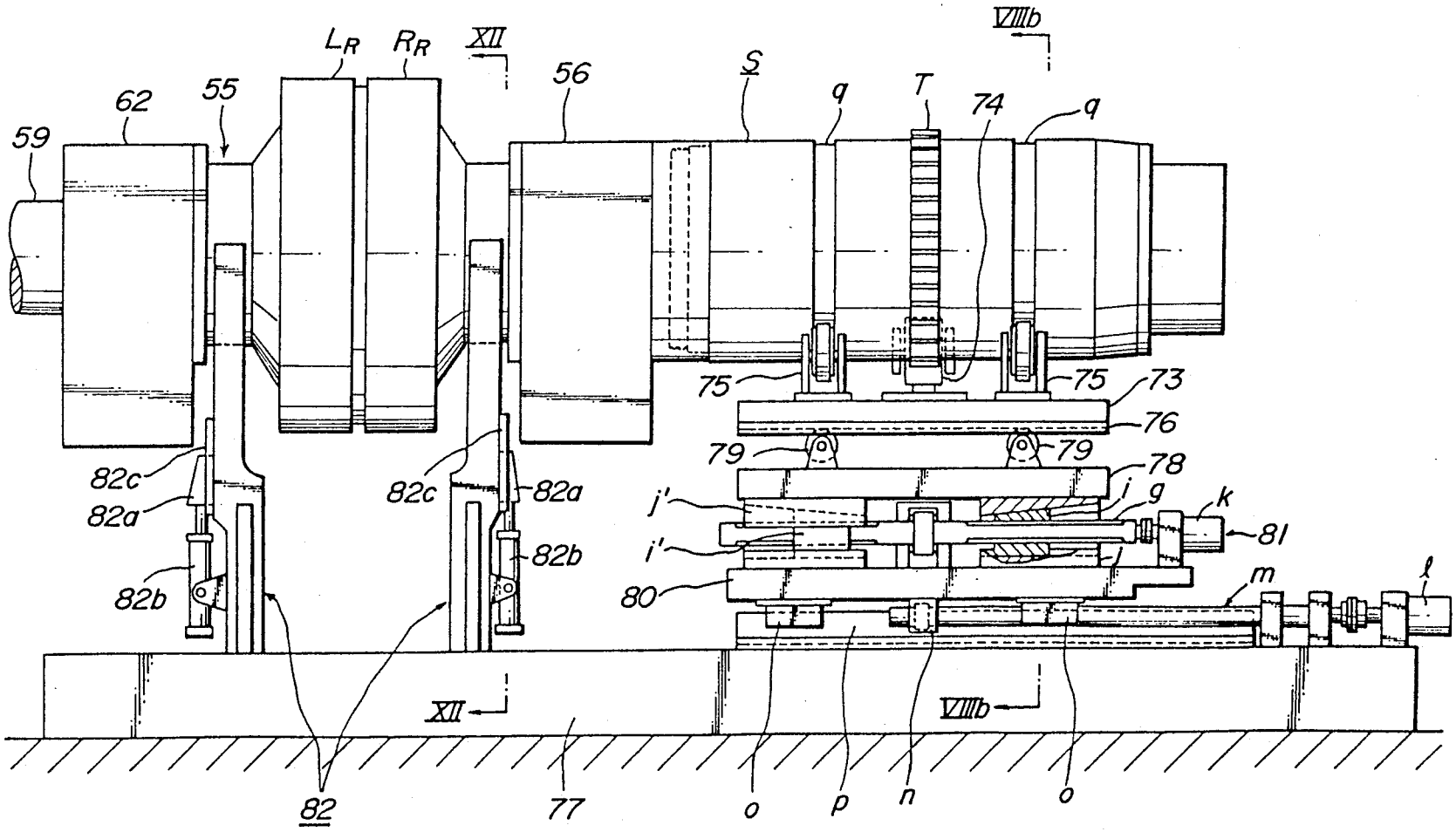
FIGS. 8*a* and 8*b* illustrating a mounting and dismounting apparatus to be used for assembling and disassembling the adjustable width roll shown in FIG. 6*a;*
Figure 8B:
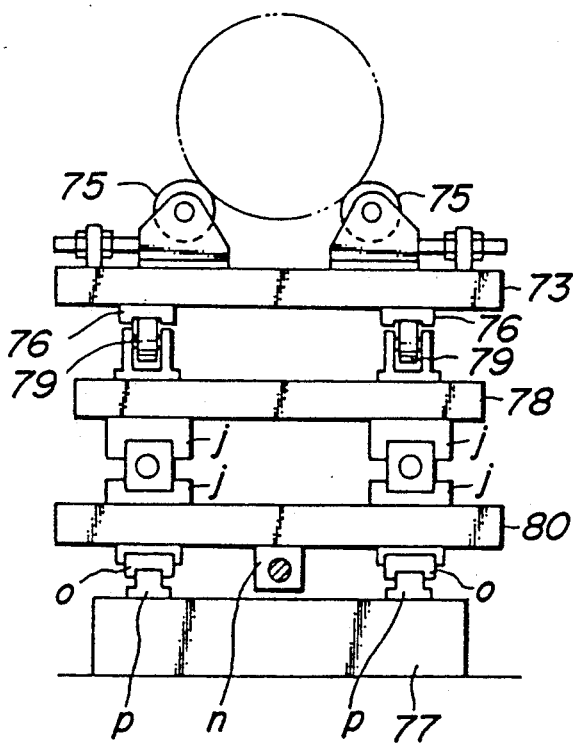

FIGS. 8a and 8b illustrate the mounting and dismounting apparatus according to the invention preferably used for mounting and dismounting the adjustable width rolls as above constructed. The apparatus includes a first frame 73 comprising on its upper surface a gear 74 having a driving power source and support rollers 75 having position adjusting means (pressing bolts or the like) for supporting the support casing S and on a lower surface a frame guide 76. The gear 74 is adapted to engage the gear T provided on the support casing S for driving it.

Figure 9A:
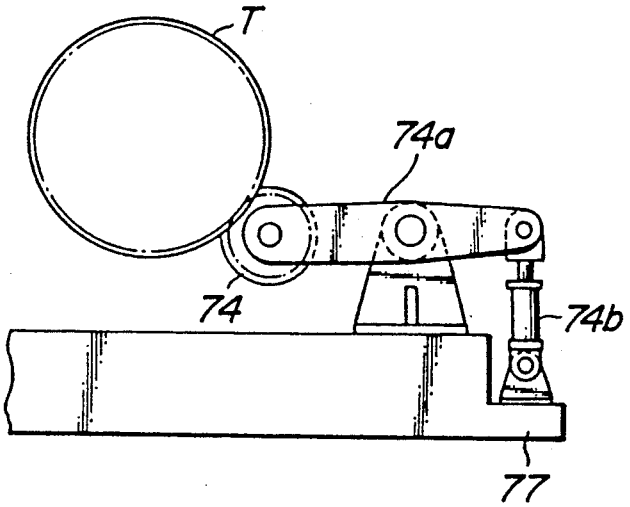
FIGS. 9*a* and 9*b* are explanatory views for a gear of the mounting and dismounting apparatus.
Figure 9B:
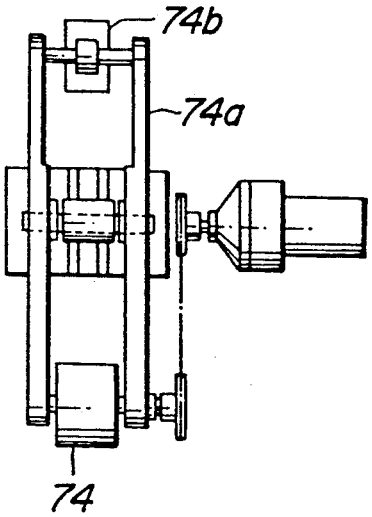

As shown in detail in FIGS. 9*a* and 9*b*, the gear 74 is rotatably supported on one end of a link lever 74*a* which is at a mid portion rockably supported on a base 77. The other end of the link lever 74*a* is connected to a rod end of a hydraulic cylinder 74*b* whose cylinder end is pivotally connected to the base 77. Therefore, the gear 74 is finely adjustable in vertical directions by extension and retraction of the piston rod of the hydraulic cylinder 74*b*.

A second frame 78 has rollers 79 adapted to engage the frame guide 76 of the first frame 73.

A third frame 80 has lifting means 81 for vertically moving the first and second frames 73 and 78 and moving means for moving the second frame 78 together with the first frame 73 in axial directions of the roll shaft 59.

The lifting means 81 comprises a screw rod g formed with right- and left-hand threads and connected to a driving source, slide shoes i and i' in the form of wedges having tapered surfaces and adapted to be threadedly engaged with the right- and left-hand threads of the screw rod g and, slide shoe guides j and j' fitting with the slide shoes i and i' for guiding them. When the screw rod g is rotated by the driving source such as an electric motor k, the slide shoes i and i' are moved toward or away from each other so that the second frame 78 is raised or lowered together with the first frame 73.

Figure 10:
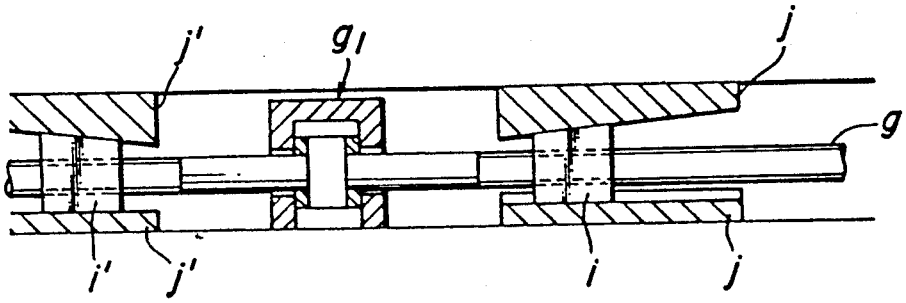
FIG. 10 is a view for explaining the lifting means of the mounting and dismounting apparatus shown in FIG. 8*a;*

FIG. 10 illustrates an important part of the lifting means 81 in section. In FIG. 10, a bearing $g_1$ serves to rotatably support the screw shaft g and at the same time prevents the screw shaft g from moving in its axial directions.

Figure 11:
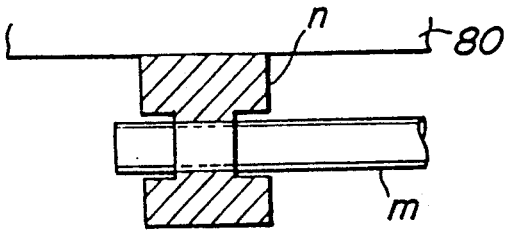
FIG. 11 is an enlarged view of a third frame of the mounting and dismounting apparatus.

In order to move the third frame 80, as shown in FIG. 11 a screw rod m is connected with one end to a driving source 1 and threadedly engaged with a block n provided on the third frame 80, and linear guides o for the third frame 80 are engaged with guide shoes p on the base 77 (FIG. 8*a*).

Roll holders 82 are provided to engage the sleeve rolls 55*a* and 55*b* fixedly supporting the axially adjustable and stationary rolls $L_R$ and $R_R$ to support the sleeve rolls 55*a* and 55*b*.

In this case, in order to firmly support the sleeve rolls 55*a* and 55*b* by the roll holders 82, the holders 82 are provided on their side surfaces with hydraulic cylinders 82*b* having wedge-shaped blocks 82*a* at rod ends. When the hydraulic cylinders 82*b* are actuated, the wedge-shaped blocks 82*a* are moved along guides 82*c* provided on the roll holders 82 to cause the wedge-shaped blocks 82*a* to insert between the roll holders 82 and the roll chocks 56 and 62.

Figure 12:
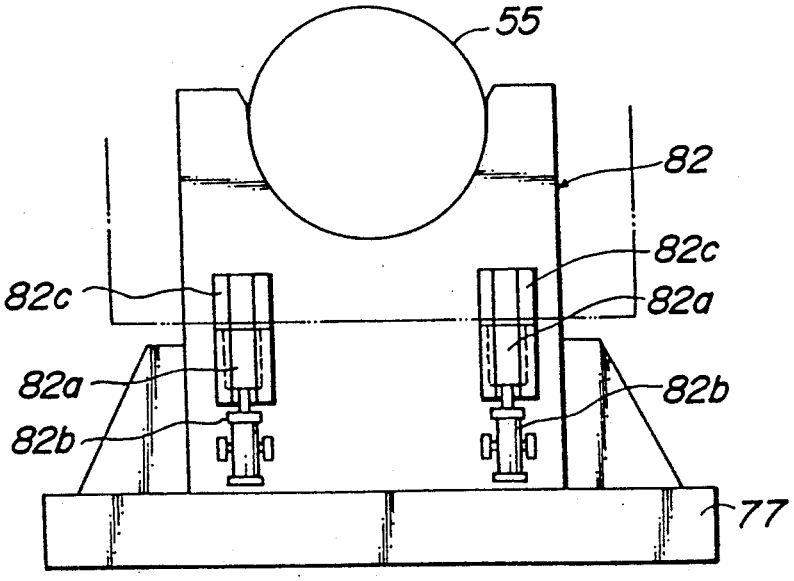
FIG. 12 is a view illustrating a roll holder of the mounting and dismounting apparatus.

FIG. 12 is a side view of the roll holder 82 in section taken along the line XII—XII in FIG. 8*a*.

Figure 5:
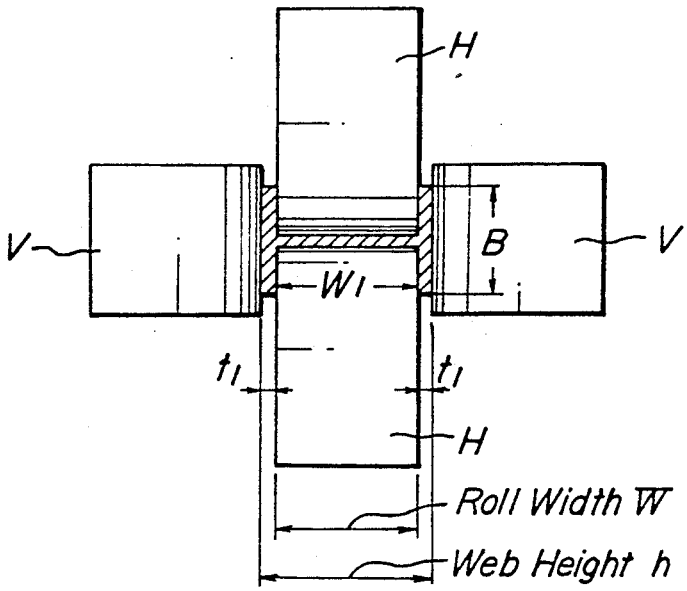
FIG. 5 is an explanatory view for rolling an H-beam.

In rolling H beams as shown in FIG. 5, widths of the H-beams B can be freely changed so long as the widths of the flanges are within widths of vertical rolls. However, since web heights h of the H-beams are determined by thicknesses $t_1$ of the flanges, various problems are raised as initially mentioned.

With the adjustable width rolls of this embodiment of the invention, when the driving power source 67 connected to the end 59*a* of the roll shaft 59 is actuated, the nut 69 connected through the clutch 68 to the driving power source 67 is rotated so that the slide block 65 is moved together with the roll shaft 59 in an axial direction away from the driving power source 67. Therefore, the total width of the axially adjustable and stationary rolls performing the rolling the H-beams 51 is easily and quickly changed or widened.

In changing the width of the rolls, moreover, the hydraulic pressure supply and exhaust circuits for the hydraulic chamber 72 are opened so as not apply the hydraulic pressure to the hydraulic chamber 72. After the total width of the rolls has been set, the hydraulic circuits are closed to supply the hydraulic pressure into the hydraulic chamber 72 to maintain it at a predetermined pressure.

Narrowing the total width of the rolls $L_R$ and $R_R$ is effected by the use of the hydraulic chamber 72 in the manner as above described.

A dismounting the horizontal roll 54*a* is then explained. The adjustable width roll with the roll chocks removed from the housing of the rolling mill is located on the roll holders 82 by the use of an overhead traveling crane and then firmly fixed to the roll holders 82 with the aid of the wedge-shaped blocks 82*a*.

The gear 74 is then brought into engagement with the gear T provided on the support casing S by adjusting lateral and vertical positions of the gear 74 by fine movements of the second and third frames 78 and 80 and the hydraulic cylinder 74*b* of the mounting and dismounting apparatus. Thereafter the gear 74 is rotatively driven by the driving power source to rotate the support casing S.

As the support casing S is connected to the bearing chock 56 of the rolling mill only by the threaded engagement, the rotation of the support casing S of a required number causes the roll width changing means to be easily and quickly removed from the rolling mill.

When the support case S is rotated, it will be moved away from the roll chock 56 in its axial direction as releasing the threaded engagement thereof. The first frame 73 is adapted to follow such the axial movement of the support case S. However, if there is a risk of the gears 74 and T being axially shifted, it is preferable to form grooves g in circumferential portions of the support casing S in contact with the support rollers 75.

Assembling the horizontal rolls will be effected in steps reverse to those in the dismounting of the horizontal roll as above described.

According to the embodiment, the following effects can be accomplished.

1) The roll width of a rolling mill can be changed when on-line by remote control.
2) Even if the rolls have been worn off, the roll widths can be correctly changed without exchanging rolls so that constant or different dimensional steel products can be produced in stable condition.
3) As the roll width changing means provided on the rolling mill is detachable therefrom, it is applicable to other existing or new rolling mills only with slight modification of the mills so that initial coats therefor can be remarkably reduced.
4) Mounting and dismounting of the rolls with the roll width changing means in maintenance can be effected in a short time to greatly contribute to reduction in number of man-hour and to saving energy.

Figure 13:
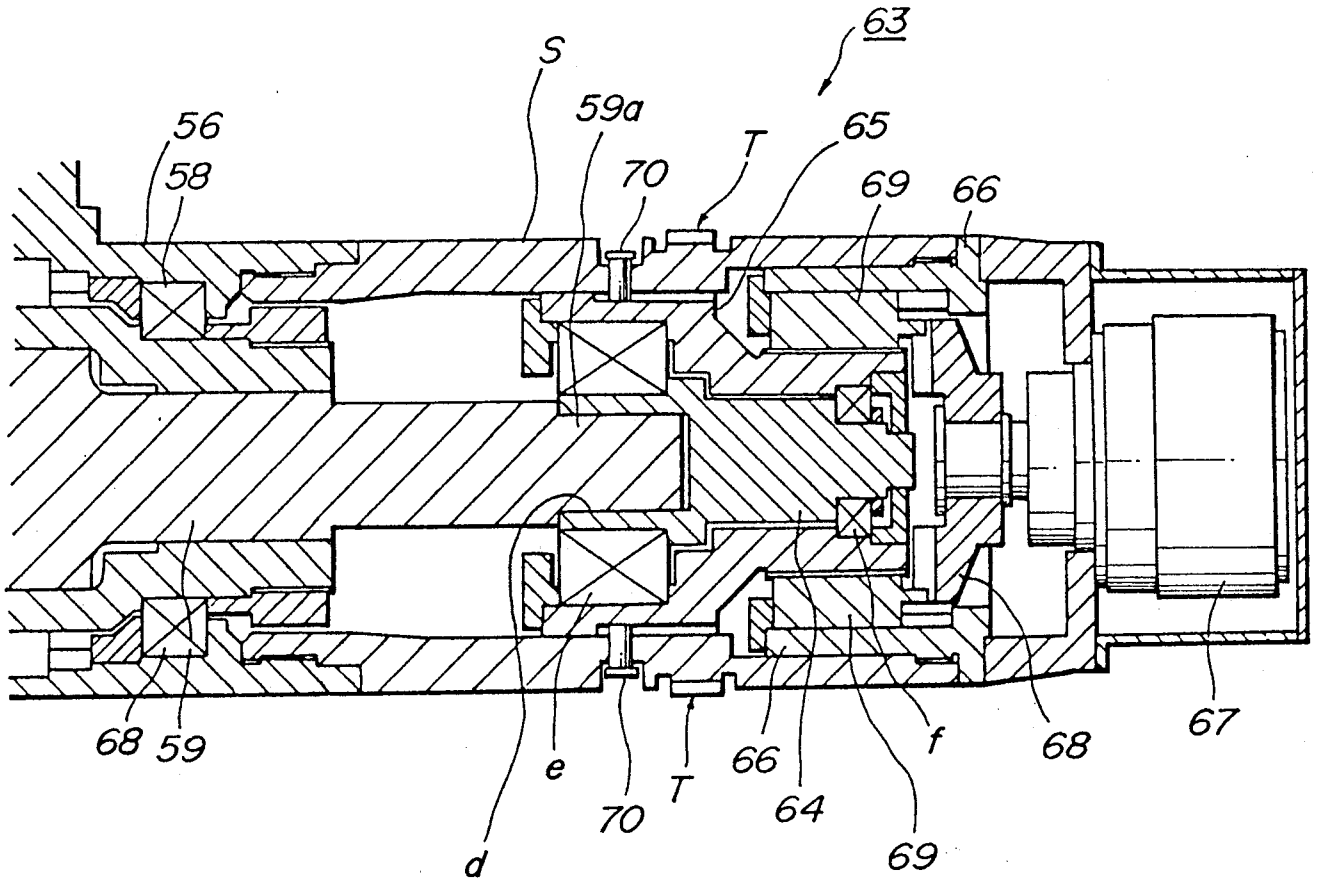
FIG. 13 is a partial sectional view illustrating one end of an adjustable width roll of third embodiment of the invention.
Figure 14:
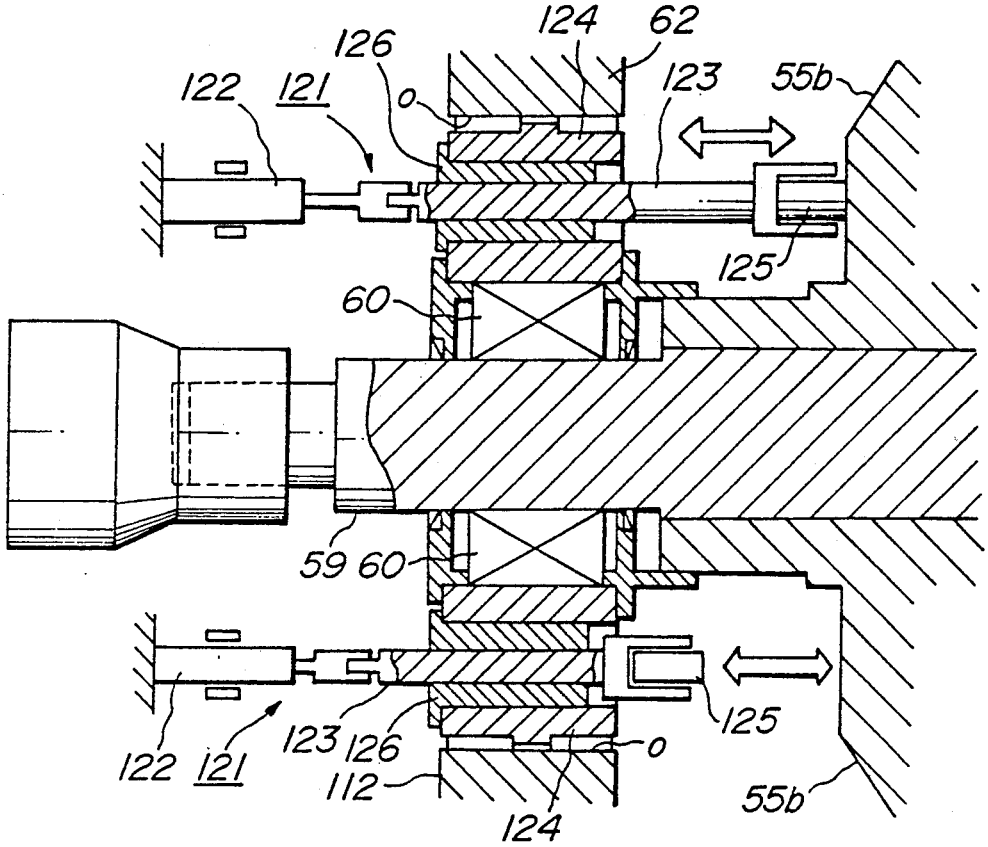
FIG. 14 is a sectional view illustrating second roll width changing means according to the invention.
Figure 15:
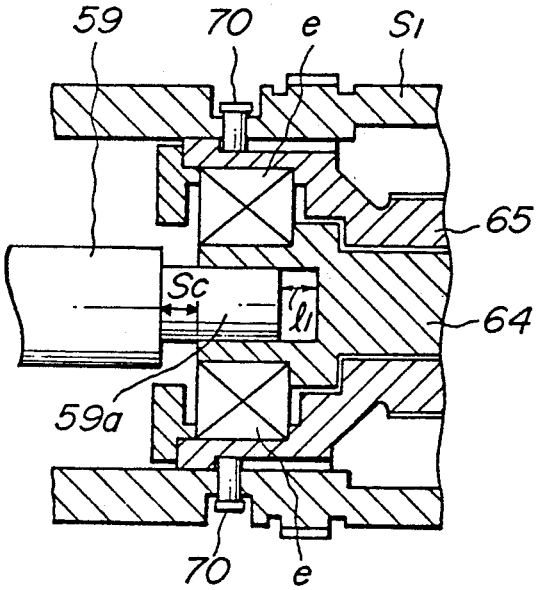
FIG. 15 is a sectional view for explaining amounts of narrowing the width of the roll by means of the second roll width changing means shown in FIG. 14.

FIGS. 13–15 illustrate a third embodiment of the invention wherein like components are designated by the same reference numerals as those in the second embodiment shown in FIGS. 6*a* and 6*b*. FIG. 13 corresponds to FIG. 6*b* showing the end of the horizontal roll 54*a* on the operating side. The remaining parts of the rolling mill except the end of the horizontal roll 54*a* of the embodiment shown in FIGS. 13–15 is substantially the same as those shown in FIG. 6*a*.

The end of the horizontal roll 54*a* of the third embodiment shown in FIG. 13 does not have the hydraulic chamber 72 and the sleeve 71 for forming the chamber 72 shown in FIG. 6*b*. The features shown in FIG. 13 will not be described in further detail since the other features of the end of the horizontal roll 54*a* of the third embodiment is substantially the same as those shown in FIG. 6*b*.

In the third embodiment, there are provided second roll width changing means 121 which are actuated to urge a sleeve roll 55*b* together with a roll shaft 59 and an axially adjustable roll $L_R$ toward an axially stationary roll $R_R$ to shorten or narrow a total roll width of the rolls $L_R$ and $R_R$.

Each of the second roll width changing means 121 preferably comprises for example a hydraulic cylinder 122 having a cylinder end secured to a housing of the rolling mill, a slide rod 123 having a roller 125 at its free end and connected to a piston rod of the hydraulic cylinder 122, and a support block 126 fitted in an opening formed in the roll chock 124 for guiding the slide rod 123.

In the third embodiment, when a driving power source 67 of the first roll width changing means 63 connected to an end 59*a* of the roll shaft 59 is actuated to rotate a nut 69 through a clutch 68, so that a slide block 65 is moved together with the roll shaft 59 onto the driving side. Therefore, the total width of the axially adjustable and stationary rolls $L_R$ and $R_R$ for rolling an H beam 51 is widened.

As can be seen from FIG. 13, the end 59*a* of the roll shaft 59 is simply fitted in an opening d of an arbor 64. Therefore, even if the driving power source 67 is actuated in a reverse direction, it may be impossible to move the roll shaft 59 onto the operating side to shorten or narrow the total width of the axially adjustable and stationary rolls $L_R$ and $R_R$.

In order to move the roll shaft 59 onto the operating side to shorten or narrow the total width of the rolls $L_R$ and $R_R$, therefore, first the slide block 65 is retracted together with the arbor 64 onto the operating side into original positions and then the slide rods 123 of the second roll width changing means 121 are brought into contact with the sleeve roll 55*b* and cause the roll shaft 59 to move onto the operating side, thereby narrowing the total width of the rolls $L_R$ and $R_R$.

The amount of narrowing width can be set at any value within a clearance Sc at the end 59*a* of the roll shaft 59 as shown in FIG. 15.

In this embodiment as above described, the widening and narrowing the total width of the rolls can be adjusted by means of separate means so that the inner construction of the first roll width changing means is particularly simplified.

As shown in FIG. 14, each of the slide rods 123 is provided at its free end with a roller. If the rollers are kept in contact with the sleeve roll 55*b*, they may prevent wobbling of parts of the rolls to improve the rolling accuracy. In general, however, it is preferable to retract the rollers from the sleeve roll out of contact therewith after setting the required width of the rolls.

Mounting and dismounting the horizontal roll are effected by the use of the mounting and dismounting apparatus explained in the second embodiment. As the support casing S is connected to the roll chock 56 only by a threaded engagement, the first roll width changing means can be easily removed from the roll chock 56 in the same manner as in the second embodiment.

According to the third embodiment, the hydraulic chamber is eliminated from the roll width changing means explained in the second embodiment to simplify its construction and operation. At the same time, the effects described in the second embodiment are also accomplished in the third embodiment.

While the invention has been particularly shown and described with reference to preferred embodiments thereof, it will be understood by those skilled in the art that the foregoing and other changes in form and details can be made therein without departing from the spirit and scope of the invention.

What is claimed is:

1. Adjustable width rolls for a rolling mill for producing H-beams, wherein each of the adjustable rolls comprises a roll shaft rotatable and axially movably supported relative to the rolling mill to form an axle member of the adjustable width roll, an axially adjustable sleeve roll fixed to the roll shaft, an axially stationary sleeve roll having said roll shaft axially and slidably passing through an axially centered opening in said axially stationary sleeve roll, said axially stationary sleeve roll and said roll shaft being rotatably joined, said axially stationary sleeve roll being non-adjustable in an axial direction, an axially adjustable work roll fixedly supported by the axially adjustable sleeve roll to form substantially one half of a rolling barrel of the adjustable width roll and arranged to engage portions of said H-beams, an axially stationary work roll fixedly supported by the axially stationary sleeve roll to form substantially the remaining half of the rolling barrel of the adjustable width roll and arranged to engage other portions of said H-beams, and driving means for driving said roll shaft in at least one axial direction thereof.

2. Adjustable width rolls for a rolling mill as set forth in claim 1, wherein said driving means comprises a motor for axially driving said roll shaft, a nut arranged to be rotatively driven by the motor, a slide block threadedly engaged with the nut and axially moved when the nut is rotated by the motor, and an arbor engaging said slide block and said roll shaft so that the roll shaft is moved in one axial direction when the slide block is axially moved.

3. Adjustable width rolls for a rolling mill as set forth in claim 2, further comprising moving means arranged on a side of the axially adjustable roll for moving the roll shaft in an axial direction opposite to said one axial direction.

4. Adjustable width rolls for a rolling mill, wherein each of the adjustable rolls comprises a roll shaft rotatable and axially movably supported relative to the rolling mill to form an axle member of the adjustable width roll, an axially adjustable sleeve roll fixed to the roll shaft, an axially stationary sleeve roll having said roll shaft axially and slidably passing through an axially centered opening in said axially stationary sleeve roll, said axially stationary roll and said roll shaft being rotatably joined, said axially stationary sleeve roll being non-adjustable in an axial direction, an axially adjustable roll fixedly supported by the axially adjustable sleeve roll to form substantially one half of a rolling barrel of the adjustable width roll, an axially stationary roll fixedly supported by the axially stationary sleeve roll to form substantially the remaining half of the rolling barrel of the adjustable width roll, and driving means for driving said roll shaft in at least one axial direction thereof, said driving means comprises a screw rod coaxially connected to said roll shaft, a nut threadedly engaged with the screw rod, and a motor for rotatively driving the nut.

5. Adjustable width rolls for a rolling mill, wherein each of the adjustable rolls comprises a roll shaft rotatable and axially movably supported relative to the rolling mill to form an axle member of the adjustable width roll, an axially adjustable sleeve roll fixed to the roll shaft, an axially stationary sleeve roll having said roll shaft axially and slidably passing through an axially centered opening in said axially stationary sleeve roll, said axially stationary roll and said roll shaft being rotatably joined, said axially stationary sleeve roll being non-adjustable in an axial direction, an axially adjustable roll fixedly supported by the axially adjustable sleeve roll to form substantially one half of a rolling barrel of the adjustable width roll, an axially stationary roll fixedly supported by the axially stationary sleeve roll to form substantially the remaining half of the rolling barrel of the adjustable width roll, and driving means for driving said roll shaft in at least one axial direction thereof, and further comprising a hydraulic chamber means between said roll shaft and said axially stationary sleeve roll for preventing axial wobbling and elastic deformation of said roll shaft and said axially stationary sleeve roll.

6. Adjustable width rolls for a rolling mill, wherein each of the adjustable rolls comprises a roll shaft rotatable and axially movably supported relative to the rolling mill to form an axle member of the adjustable width roll, an axially adjustable sleeve roll fixed to the roll shaft, an axially stationary sleeve roll having said roll shaft axially and slidably passing through an axially centered opening in said axially stationary sleeve roll, said axially stationary roll and said roll shaft being rotatably joined, said axially stationary sleeve roll being non-adjustable in an axial direction, an axially adjustable roll fixedly supported by the axially adjustable sleeve roll to form substantially one half of a rolling barrel of the adjustable width roll, an axially stationary roll fixedly supported by the axially stationary sleeve roll to form substantially the remaining half of the rolling barrel of the adjustable width roll, and driving means for driving said roll shaft in at least one axial direction thereof, said driving means comprising a motor for axially driving said roll shaft, a nut arranged to be rotatively driven by the motor, a slide block threadedly engaged with the nut and axially moved when the nut is rotated by the motor, an arbor engaging said slide block and said roll shaft so that the roll shaft is moved in one axial direction when the slide block is axially moved, and a hydraulic chamber between the roll shaft and the axially stationary sleeve roll, and a sleeve connected to the roll shaft to form one wall of the hydraulic chamber, thereby causing the roll shaft to move in an axial direction opposite to said one axial direction when hydraulic pressure is applied to the hydraulic chamber.

7. Adjustable width rolls for a rolling mill, wherein each of the adjustable rolls comprises a roll shaft rotatable and axially movably supported relative to the rolling mill to form an axle member of the adjustable width roll, an axially adjustable sleeve roll fixed to the roll shaft, an axially stationary sleeve roll having said roll shaft axially and slidably passing through an axially centered opening in said axially stationary sleeve roll, said axially stationary roll and said roll shaft being rotatably joined, said axially stationary sleeve roll being non-adjustable in an axial direction, an axially adjustable roll fixedly supported by the axially adjustable sleeve roll to form substantially one half of a rolling barrel of the adjustable width roll, an axially stationary roll fixedly supported by the axially stationary sleeve roll to form substantially the remaining half of the rolling barrel of the adjustable width roll, driving means for driving said roll shaft in at least one axial direction thereof, said driving means comprises a motor for axially driving said roll shaft, a nut arranged to be rotatively driven by the motor, a slide block threadedly engaged with the nut and axially moved when the nut is rotated by the motor, an arbor engaging said slide block and said roll shaft so that the roll shaft is moved in one axial direction when the slide block is axially moved, and moving means arranged on a side of the axially adjustable roll for moving the roll shaft in an axial direction opposite to said one axial direction, said moving means comprising at least one hydraulic cylinder whose cylinder end is secured to a frame of the rolling mill and whose piston rod has at a free end a slide rod slidable relative to the frame of the mill and engaging one of the roll shaft, the axially adjustable sleeve roll and the axially adjustable roll.

8. Adjustable width rolls for a rolling mill, wherein each of the adjustable rolls comprises a roll shaft rotatable and axially movably supported relative to the rolling mill to form an axle member of the adjustable width roll, an axially adjustable sleeve roll fixed to the roll shaft, an axially stationary sleeve roll having said roll shaft axially and slidably passing through an axially centered opening in said axially stationary sleeve roll, said axially stationary roll and said roll shaft being rotatably joined, said axially stationary sleeve roll being non-adjustable in an axial direction, an axially adjustable roll fixedly supported by the axially adjustable sleeve roll to form substantially one half of a rolling barrel of the adjustable width roll, an axially stationary roll fixedly supported by the axially stationary sleeve roll to form substantially the remaining half of the rolling barrel of the adjustable width roll, and driving means for driving said roll shaft in at least one axial direction thereof, the adjustable width roll further comprising a support casing supporting said driving means and surrounding one end of the roll shaft on a side of the driving means, said support casing threadedly engaged with a roll chock of the adjustable width roll and being provided on its outer circumference with a gear, and a mounting and dismounting apparatus comprising a gear to be in mesh with said gear provided on the support casing and driven by a driving power source, rollers for supporting the support casing, and position adjusting means for adjusting positional relations between the support casing and the gear and the rollers provided on the mounting and dismounting apparatus.

9. Adjustable width rolls for a rolling mill as set forth in claim 8, wherein said gear provided on the mounting and dismounting apparatus comprises a link lever rockably supported at a mid portion and having one end rotatably supporting the gear and the other end connected with a hydraulic cylinder so that the gear is moved toward and away from the gear provided on the support casing.

10. Adjustable width rolls for a rolling mill as set forth in claim 8, wherein the support casing is formed in its circumference with grooves to be fitted with the rollers provided for supporting the support casing.

11. Adjustable width rolls for a rolling mill as set forth in claim 8, wherein said mounting and dismounting apparatus further comprises at least one roll holder for supporting either of the sleeve rolls, said roll holder comprising a main frame, a hydraulic cylinder fixed to the main frame, and a wedge-shaped block provided at a piston rod of the hydraulic cylinder to be moved by the hydraulic cylinder along a guide provided on the main frame.

12. Adjustable width rolls for a rolling mill, wherein each of the adjustable width rolls comprises:

a roll shaft rotatable and axially movably supported relative to the rolling mill to form an axle member of the adjustable width roll;

an axially adjustable sleeve roll fixed to the roll shaft;

an axially stationary sleeve roll mounted on the roll shaft to be axially slidable but rotatable with the roll shaft;

an axially adjustable roll fixedly supported by the axially adjustable sleeve roller to form substantially one half of a rolling barrel of the adjustable width roll;

an axially stationary roll fixedly supported by the axially stationary sleeve roll to form substantially the remaining half of the rolling barrel of the adjustable width roll;

and driving means for driving said roll shaft in at least one axial direction thereof, said driving means further comprising:

a motor for axially driving said roll shaft;

a nut arranged to be rotatively driven by the motor;

a slide block threadedly engaged with the nut and axially moved when the nut is rotated by the motor;

an arbor engaging said slide block and said roll shaft so that the roll shaft is moved in one axial direction when the slide block is axially moved;

a hydraulic chamber between the roll shaft and the axially stationary sleeve roll; and a sleeve connected to the roll shaft to form one wall of the hydraulic chamber thereby causing the roll shaft to move in an axial direction opposite to said one axial direction when hydraulic pressure is applied to the hydraulic chamber.

13. Adjustable width rolls for a rolling mill, wherein each of the adjustable width rolls comprises:

a roll shaft rotatable and axially movably supported relative to the rolling mill to form an axle member of the adjustable width roll;

an axially adjustable sleeve roll fixed to the roll shaft;

an axially stationary sleeve roll mounted on the roll shaft to be axially slidable but rotatable with the roll shaft;

an axially adjustable roll fixedly supported by the axially adjustable sleeve roller to form substantially one half of a rolling barrel of the adjustable width roll;

an axially stationary roll fixedly supported by the axially stationary sleeve roll to form substantially the remaining half of the rolling barrel of the adjustable width roll; and and driving means for driving said roll shaft in at least one axial direction thereof, said driving means further comprising:

a motor for axially driving said roll shaft;

a nut arranged to be rotatively driven by the motor;

a slide block threadedly engaged with the nut and axially moved when the nut is rotated by the motor; and an arbor engaging said slide block and said roll shaft so that the roll shaft is moved in one axial direction when the slide block is axially moved; and a moving means arranged on a side of the axially adjustable roll for moving the roll shaft in an axial direction opposite to said one axial direction, said moving means comprising at least one hydraulic cylinder whose cylinder end is secured to a frame of the rolling mill and whose piston rod has at a free end a slide rod slidable relative to the frame of the mill and engaging either of the roll shaft, the axially adjustable sleeve roll and the axially adjustable roll.

14. Adjustable width rolls for a rolling mill, wherein each of the adjustable width rolls comprises:

a roll shaft rotatable and axially movably supported relative to the rolling mill to form an axle member of the adjustable width roll;

an axially adjustable sleeve roll fixed to the roll shaft;

an axially stationary sleeve roll mounted on the roll shaft to be axially slidable but rotatable with the roll shaft;

an axially adjustable roll fixedly supported by the axially adjustable sleeve roller to form substantially one half of a rolling barrel of the adjustable width roll;

an axially stationary roll fixedly supported by the axially stationary sleeve roll to form substantially the remaining half of the rolling barrel of the adjustable width roll; and driving means for driving said roll shaft in at least one axial direction thereof, wherein said adjustable width roll further comprises:

a support casing supporting said driving means and surrounding one end of the roll shaft on a side of the driving means;

a roll chock, said support casing threadedly engaged with the roll chock and being provided on its outer circumference with a gear;

a mounting and dismounting apparatus comprising a gear to be in mesh with said gear provided on the outer circumference of the support casing and driven by a power source of the driving means;

rollers for supporting the support casing; and position adjusting means for adjusting positional relations between the support casing and the gear and rollers provided on the mounting and dismounting apparatus.

* * * * *